US006269574B1

(12) United States Patent
Sokolofski

(10) Patent No.: US 6,269,574 B1
(45) Date of Patent: Aug. 7, 2001

(54) PROMOTIONAL TACK

(75) Inventor: Edward G. Sokolofski, Wilmette, IL (US)

(73) Assignee: American Greenwood, Inc., Chicago, IL (US)

( * ) Notice: Subject to any disclaimer, the term of this patent is extended or adjusted under 35 U.S.C. 154(b) by 0 days.

(21) Appl. No.: 09/404,249

(22) Filed: Sep. 22, 1999

(51) Int. Cl.[7] ..... G09F 3/12

(52) U.S. Cl. ..... 40/668; 40/1.5; 40/662

(58) Field of Search ..... 40/1.5, 1.6, 622, 40/661.04, 661.05, 668, 662; 411/439, 487; D8/388, 391; 63/12, 13, 20

(56) References Cited

U.S. PATENT DOCUMENTS

| | | | | |
|---|---|---|---|---|
| 553,708 | | 1/1896 | Forehand . | |
| 562,656 | | 6/1896 | Phelps . | |
| 784,077 | | 3/1905 | Smith et al. . | |
| 1,215,675 | | 2/1917 | Lynch . | |
| 1,241,290 | * | 9/1917 | Senftner | 40/669 |
| 1,512,565 | | 10/1924 | Ross . | |
| 1,785,186 | | 12/1930 | Day . | |
| 2,178,024 | * | 10/1939 | Pompilio | 40/669 |
| 2,301,049 | | 11/1942 | Kaynor et al. . | |
| 3,257,747 | * | 6/1966 | Schimmel | 40/1.5 |
| 3,546,797 | * | 12/1970 | Oleson | 40/1.5 |
| 3,942,273 | * | 3/1976 | Adams | 40/1.5 |
| 4,597,206 | | 7/1986 | Benson . | |
| 4,777,744 | | 10/1988 | Barnett . | |
| 5,782,022 | * | 7/1998 | Tubberville | 40/1.5 X |
| 6,178,680 | * | 1/2001 | Sloot | 40/661.04 X |

* cited by examiner

*Primary Examiner*—Brian K. Green
(74) *Attorney, Agent, or Firm*—Seyfarth Shaw

(57) ABSTRACT

A promotional tack includes a standard thumbtack having a head sandwiched between significantly larger front and rear outer structures coaxially therewith, the tack having a shaft extending through an aperture in the rear structure while the front structure has an indicia-bearing obverse surface. The front structure includes a metal plate and the indicia may be imprinted directly on the metal plate or on a laminated flexible sheet covering the metal plate.

10 Claims, 2 Drawing Sheets

PROMOTIONAL TACK

BACKGROUND OF THE INVENTION

The present invention relates to promotional pins or tacks of the type having a relatively large obverse surface for bearing a promotional message or the like, and having a shaft terminating in a pointed end, to pierce a bulletin board, cork board or other support surface for mounting the tack in a display position.

Heretofore, such promotional tacks have been made by simply forming a modified common thumbtack with a very large head. Indicia may be printed directly on the obverse surface of the enlarged head, or, alternatively, a front outer plate or sheet may overlie the tack head with its periphery wrapped around the periphery of the tack head, the indicia being printed on the obverse surface of the outer plate or sheet. The drawback of such prior designs is that it is relatively costly to form specialized thumbtacks with very large heads.

Another prior art approach is to provide an enlarged front plate with an indicia-bearing obverse surface, and secure to its rear surface the head of a standard thumbtack, such as by two-sided tape. However this arrangement is not very sturdy and the thumbtack has a tendency to separate from the front plate. Furthermore, it is somewhat unsightly.

SUMMARY OF THE INVENTION

It is a general object of the invention to provide an improved promotional tack which avoids the disadvantages of prior promotional tacks while affording additional structural and operating advantages.

An important feature of the invention is the provision of a promotional tack which is sturdy and not subject to disassembly or disintegration in use.

Another feature of the invention is the provisions of a promotional tack of the type set forth, which is attractive and yet characterized by a simple and economical construction.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
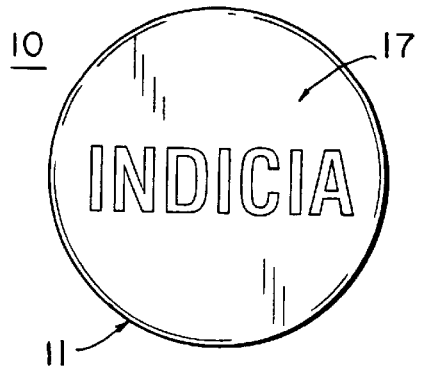
FIG. 1 is a front elevational view of a promotional tack in accordance with an embodiment of the present invention.
Figure 2:
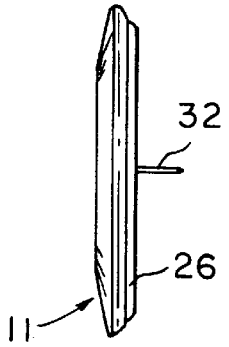
FIG. 2 is a side elevational view of the tack of FIG. 1.
Figure 3:
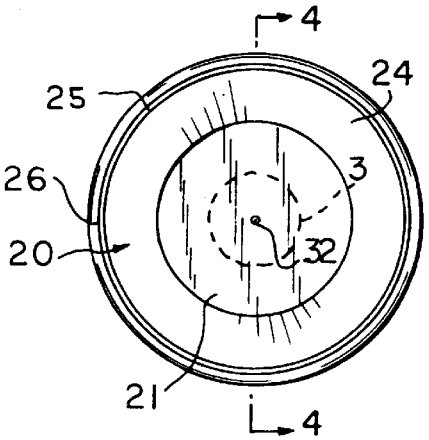
FIG. 3 is a rear elevational view of the tack of FIG. 1.

Referring to FIGS. 1–4, there is illustrated a promotional tack, generally designated by the numeral 10, constructed in accordance with a first embodiment of the present invention. The tack 10 includes an enlarged, circular, front outer structure 11, which includes a circular, substantially rigid substrate 12, preferably in the form of a metal plate, having a main wall 13. The main wall 13 has a flat central portion **13*a* joined by a slightly convex annular portion 13*b* to a rearwardly projecting peripheral flange 14. The front structure 11 also includes a sheet 15, preferably formed of a suitable flexible material, such as a suitable paper, having an obverse surface 16 on which are imprinted indicia 17. Preferably, the obverse surface 16 is covered with a transparent layer 18, which may be formed of a suitable plastic material, and which may be in the form of a sheet or coating laminated to the sheet 15. Preferably, the sheet 15 and its laminated layer 18 cover the entire front of the substrate 12, including the flange 15, and is wrapped over the distal edge of the flange 15, as can best be seen in FIG. 4. It will be appreciated that the layer 18 protects the sheet 15, while permitting viewing of the indicia 17**.

The tack 10 also includes an enlarged, circular, rear outer structure in the form of a substantially rigid plate 20, having a flat, planar, circular, central portion 21 with a small circular aperture 22 formed therethrough centrally thereof. The central portion 21 has a front surface 23 and is integral at its periphery with a rearwardly extending, annular, inclined shoulder 24 which is, in turn, integral with an arcuate, recurved, annular rib 25, which terminates in a forwardly projecting, annular peripheral lip 26. Preferably, plate 20 is formed of a suitable metal, but it could be formed of any other rigid material, such as plastic, chip board, etc.

The tack 11 also includes a standard thumbtack 30, having a circular head 31, which is preferably flat and is integral at its center with a rearwardly projecting shaft 32 terminating in a sharp point 33, all in a well-known manner.

Figure 4:
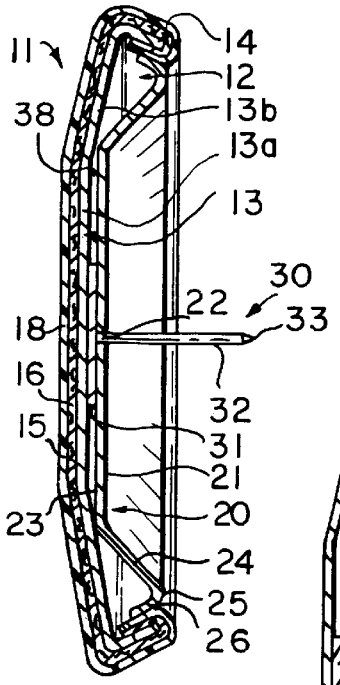
FIG. 4 is an enlarged sectional view taken generally along the line 4–4 in FIG. 3.

Referring to FIG. 4, in assembly, the shaft 32 of the thumbtack 30 is first inserted through the aperture 22 of the rear plate 20, from the front surface 23 to the rear thereof, until the head 31 engages the front surface 23. In this regard, the diameter of the shaft 32 is preferably substantially the same as that of the aperture 22 to provide a snug frictional fit which inhibits any lateral movement. Then the sheet 15 and its laminated layer 18 are wrapped over the substrate 12 to form the front outer structure 11, which is then arranged coaxially with the rear plate 20 and is press fitted together therewith. More specifically, the covered flange 15 is pressed over the peripheral lip 26, preferably with the aid of a suitable press fixture (not shown) in a well-known manner, to bring the parts to the assembled condition illustrated in FIG. 4. As thus assembled, it can be seen that the substrate 12 and the plate 20 cooperate to define a central space 38 therebetween (FIG. 4) just large enough to accommodate the head 31 of the thumbtack 30, clamping it in place and preventing axial movement of the thumbtack 30 relative to the front and rear structures.

In the illustrated embodiment, the obverse surface 16 has a diameter approximately four times that of the thumbtack head 31, but it will be appreciated that this is simply for purposes of illustration. The promotional tack 10 may be made with an outer member obverse surface 16 of any desired diameter, as long as it is substantially greater than that of the thumbtack head 31. Furthermore, while the promotional tack 10 has a circular shape, that is not essential, and it will be appreciated that the tack could be made in any desired shape. Also, the cross-sectional profile of the main wall 13 of the substrate 12 is not critical. It could be continuously convex, as viewed from the front, or completely flat. It will be appreciated that the inclined shoulder 24 of the rear member 20 is dimensioned so that, when assembled, the central portion 21 will be close enough to the central portion 13a of the main wall 13 to effectively trap the thumbtack head 31, while allowing the thumbtack shaft 32 to extend rearwardly well beyond the rib 25 of the plate 20 to afford an effective length of penetration of an associated support member for mounting purposes.

Figure 5:
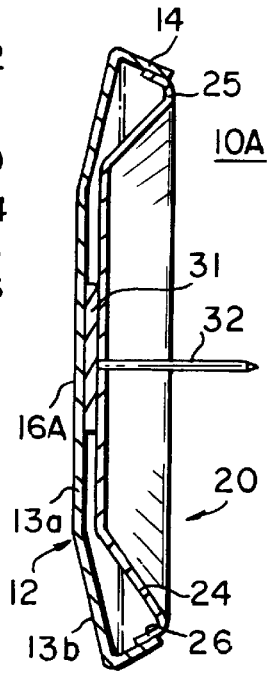
FIG. 5 is a view similar to FIG. 4, illustrating an alternative embodiment of the invention.

Referring to FIG. 5, there is shown an alternative form of the invention, generally designated by the numeral 10A, which is similar to the promotional tack 10, with the exception that the indicia 17 are printed directly on an obverse surface 16A of the substrate 12, the sheet 15 and transparent layer 18 being omitted.

Figure 6:
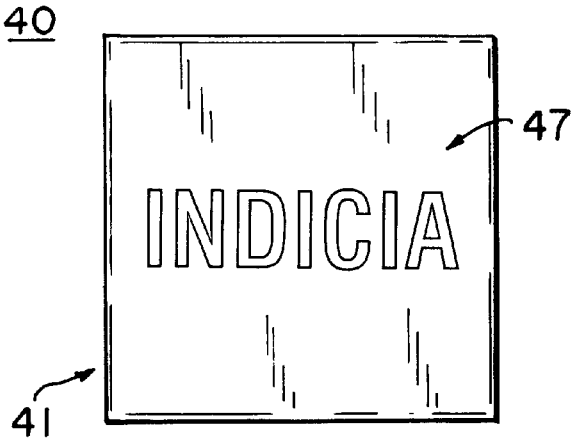
FIG. 6 is a front elevational view of another embodiment of the invention.
Figure 7:
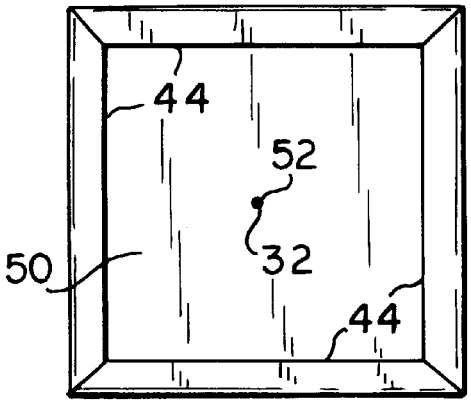
FIG. 7 is a rear elevational view of the embodiment of FIG. 6.
Figure 8:
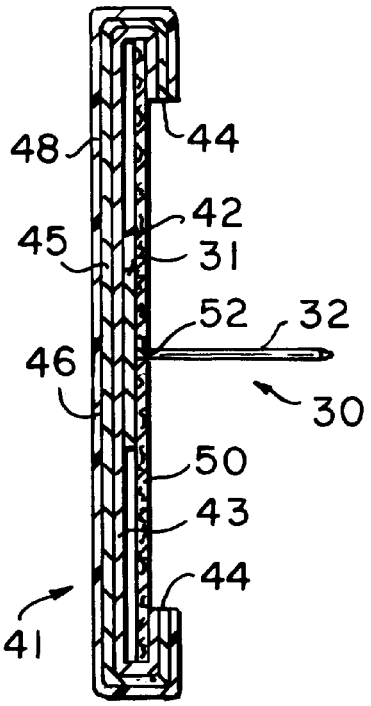
FIG. 8 is an enlarged sectional view taken generally along the line 8–8 in FIG. 7.

Referring now to FIGS. 6–8, there is illustrated another embodiment of the invention, generally designated by the numeral 40, which is similar to the promotional tack 10, but is rectangular in shape. The promotional tack 40 has an enlarged outer structure 41 including a rigid substrate 42 having a flat, rectangular main wall 43 with four generally trapezoidal peripheral flanges 44. The front outer structure 41 also includes a sheet 45 formed of a suitable flexible material, such as a suitable paper, and having substantially the same shape and size of the substrate 42, and having an obverse surface 46 bearing indicia 47. The obverse surface 46 is preferably covered with a transparent layer 48, preferably formed of a suitable plastic material which may be in the form of a layer or coating laminated to the obverse surface 46 of the sheet 45. The laminated sheet 45 and layer 48 are preferably secured, by any suitable means, to the front surface of the substrate 42.

The tack 40 is also provided with a rear outer structure in the form of a relatively rigid plate 50 of the same size and shape as the main wall 43 of the substrate 42. The plate 50 is formed of chip board or other rigid material and has a central aperture 52 which, in assembly, receives therethrough the shaft 32 of the thumbtack 30 in the same manner as described above with respect to the promotional tack 10: Then, the front outer structure 41 is secured to the rear plate 50 by folding the flanges 44 over the edges of the plate 50, thereby clamping the thumbtack head 31 between the substrate 42 and the plate 50, as seen in FIG. 8.

While the promotional tack 40 has the indicia 47 printed on a laminated, flexible sheet assembly covering the substrate 42, it will be appreciated that the indicia 47 could be imprinted directly on the front of the substrate 42, as in the embodiment of FIG. 5. Also, while, in the illustrated embodiments, promotional tacks of circular and rectangular shapes are illustrated, it will be appreciated that the principles of the present invention are applicable to any desired promotional tack shape, such as oval, heart-shaped, hexagonal, or any other shape which would be appropriate to a particular promotional message to be conveyed.

While, in the illustrated embodiments, the substrates 12 and 42 are formed of metal, it will be appreciated that they could be formed of other rigid materials. Also, while flat-headed thumbtacks are preferred, other standard thumbtack configurations, such as crowned-head, could be used.

While particular embodiments of the present invention have been shown and described, it will be apparent to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A promotional tack comprising:

two large-area outer structures each having a peripheral portion, one of said outer structures having an indicia-bearing obverse surface and the other of said outer structures having an aperture therethrough, and a thumbtack having a head and a pointed shaft with said head having an area substantially less than that of said outer structures, one of the outer structures having a peripheral flange which is pressed over the peripheral portion of the other outer structure so that said outer structures are secured together along their peripheral portions with said head sandwiched therebetween and said shaft extending through said aperture, and a substantially transparent layer covering said obverse surface.

2. The tack of claim 1, wherein said outer structures are substantially coaxial with each other and with said shaft.

3. The tack of claim 1, wherein said head is disposed in contact with each of said outer structures, thereby inhibiting movement of said thumbtack axially of said shaft.

4. The tack of claim 1, wherein said shaft is frictionally receivable through said aperture, thereby to inhibit lateral movement of said thumbtack relative to said outer structures.

5. The tack of claim 1, wherein said one of said outer structures includes a rigid substrate having a front surface and a flexible sheet covering said front surface and having said obverse surface thereon.

6. A promotional tack comprising:

a thumbtack having a head and a shaft projecting from said head substantially perpendicular thereto and terminating in a sharp point, a front structure having an obverse indicia-bearing surface substantially broader than the head and a first peripheral portion, the front structure including a relatively rigid metal front plate having a front surface and a flexible sheet covering the front surface and having the obverse surface thereon, a rear structure substantially broader than the head and having an aperture therethrough and a second peripheral portion, the rear structure including a relatively rigid rear plate, said front and rear structures being secured together at said peripheral portions, said head being disposed between said front and rear structures with said shaft disposed through said aperture and projecting rearwardly from said rear structure, and a substantially transparent layer covering said indicia-bearing obverse surface.

7. The tack of claim 6, wherein each of said front and rear plates is formed of metal.

8. The tack of claim 6, wherein said front and rear structures are secured together only at said peripheral portions.

9. The tack of claim 8, wherein said front structure has a peripheral flange which is folded over a peripheral portion of the rear structure.

10. The tack of claim 6, wherein said thumbtack is disposed in engagement with said front and rear structures for retaining said thumbtack in place and inhibiting movement thereof relative to said front and rear structures.

* * * * *